US010427927B2

(12) United States Patent
Leibinger

(10) Patent No.: US 10,427,927 B2
(45) Date of Patent: Oct. 1, 2019

(54) METHOD FOR FILLING A CONTAINER WITH A LIQUID

(71) Applicant: Leibinger GmbH, Teningen (DE)

(72) Inventor: Benedikt Leibinger, Freiburg (DE)

(73) Assignee: Leibinger GmbH, Teningen (DE)

( * ) Notice: Subject to any disclaimer, the term of this patent is extended or adjusted under 35 U.S.C. 154(b) by 317 days.

(21) Appl. No.: 15/448,617

(22) Filed: Mar. 3, 2017

(65) Prior Publication Data

US 2017/0174492 A1 Jun. 22, 2017

Related U.S. Application Data

(63) Continuation of application No. 14/113,427, filed as application No. PCT/DE2012/000309 on Mar. 22, 2012, now abandoned.

(30) Foreign Application Priority Data

May 5, 2011 (DE) ..... 10 2011 100 560

(51) Int. Cl.
*B67C 3/06* (2006.01)
*B67C 3/26* (2006.01)
(Continued)

(52) U.S. Cl.
CPC ..... *B67C 3/06* (2013.01); *B67C 3/02* (2013.01); *B67C 3/10* (2013.01); *B67C 3/2614* (2013.01);
(Continued)

(58) Field of Classification Search
CPC ..... B65B 31/046; B65B 31/06; B65B 31/04; B67C 2003/2688; B67C 3/06;
(Continued)

(56) References Cited

U.S. PATENT DOCUMENTS 601,877 A * 4/1898 Lochmann ..... F25D 3/08 222/130
2,063,430 A * 12/1936 Graser ..... B05B 9/047 222/386.5
(Continued)

FOREIGN PATENT DOCUMENTS

FR 1150289 A * 1/1958 ..... B65D 77/06
WO WO-2018172913 A1 * 9/2018 ..... B65D 77/06

*Primary Examiner* — Alexander M Valvis
*Assistant Examiner* — Lucas E. A. Palmer
(74) *Attorney, Agent, or Firm* — Gudrun E. Huckett

(57) ABSTRACT

In a method for filling a bottle, a balloon body extends through an axial through bore of a cap and is connected seal-tightly with an upper circumferential rim to the cap above a radial opening of the cap. An elongate support associated with the balloon body is connected to the cap. Balloon and elongate support are inserted into the bottle. The cap is positioned at a spacing above the bottle neck to form a ring-shaped intermediate gap. Air contained in the bottle interior is forced out through the intermediate gap by inflating the balloon body with an expansion medium. Subsequently, the cap is fluid-tightly fitted on the bottle neck. The expansion medium is allowed to escape from the balloon body and liquid is supplied through radial and axial openings of the cap into the space between outer surface of the balloon body and inner bottle wall.

14 Claims, 6 Drawing Sheets

(51) Int. Cl.

| | |
|---|---|
| ***B67C 9/00*** | (2006.01) |
| ***B67C 3/10*** | (2006.01) |
| ***B67C 3/02*** | (2006.01) |
| *B65B 31/04* | (2006.01) |
| *B65B 31/06* | (2006.01) |

(52) U.S. Cl.
CPC ..... *B67C 9/00* (2013.01); *B65B 31/046* (2013.01); *B65B 31/06* (2013.01); *B67C 2003/2688* (2013.01)

(58) Field of Classification Search
CPC ..... B67C 3/2614; B67C 3/02; B67C 3/10; B67C 9/00; B65D 83/0055; B65D 83/0061; B65D 83/62; B67D 7/0244; B67D 1/04; B67D 1/045
USPC ..... 53/175, 432, 471; 215/12.2, 12.1, 228, 215/229, 311, 310, 309, 307; 220/723, 220/720; 141/7, 59–61; 222/542, 386.5
See application file for complete search history.

(56) References Cited

U.S. PATENT DOCUMENTS 2,564,163 A * 8/1951 Leperre ..... B65D 77/06 141/114
2,673,013 A * 3/1954 Hester ..... G01F 11/262 222/386.5
2,762,534 A * 9/1956 Kish ..... B67D 1/045 222/386.5
3,072,296 A * 1/1963 Isreeli ..... B01F 15/04 222/132
3,306,503 A * 2/1967 Page ..... B67D 1/045 222/386.5
3,343,701 A * 9/1967 Mahoney ..... B67D 1/045 215/231
3,361,303 A * 1/1968 Jacuzzi ..... B65D 83/0061 128/DIG. 12
3,590,888 A * 7/1971 Coleman ..... B65D 88/62 141/313
3,767,078 A * 10/1973 Gortz ..... B65D 83/0061 220/723
3,907,169 A * 9/1975 Gortz ..... B65D 83/0061 222/95
4,239,132 A * 12/1980 Mueller ..... B05B 11/0059 222/212
4,392,578 A * 7/1983 Fipp ..... B65D 81/2076 215/231
4,436,124 A * 3/1984 Borstelmann ..... B67C 3/10 141/37
4,482,072 A * 11/1984 Hankins ..... B65B 31/047 215/231
4,684,033 A * 8/1987 Marcus ..... C12H 1/22 215/269
4,722,463 A * 2/1988 Anderson ..... B67D 3/00 137/588
4,763,818 A * 8/1988 Stefano ..... A47K 5/1211 222/209
4,809,884 A * 3/1989 Stackhouse ..... B67D 1/045 222/153.04
4,865,224 A * 9/1989 Streck ..... B65D 83/0055 222/95
4,869,402 A * 9/1989 Ash, Jr. ..... B67D 1/045 222/209
4,984,713 A * 1/1991 Chambers ..... B65D 23/00 215/12.1
4,989,650 A * 2/1991 Weiss ..... B67C 3/06 141/198
5,139,179 A * 8/1992 Cecil ..... B67D 1/0412 222/399
5,248,064 A * 9/1993 Claycomb, Jr. ..... B67D 1/0462 222/386.5
5,343,901 A * 9/1994 Meshberg ..... B05B 11/0037 141/2
5,398,852 A * 3/1995 Lacy ..... B05B 9/0838 222/386.5
5,499,758 A * 3/1996 McCann ..... B67D 1/045 222/386.5
5,505,039 A * 4/1996 Maier ..... B65B 31/00 141/20
5,823,402 A * 10/1998 Moyer ..... B67D 7/0244 222/383.1
6,220,311 B1 * 4/2001 Litto ..... B67D 1/045 141/114
6,345,739 B1 * 2/2002 Mekata ..... B65D 83/62 141/20
6,357,488 B1 * 3/2002 Brossard ..... B65B 55/022 141/1
6,502,725 B1 * 1/2003 Alexander ..... B67D 1/0456 222/105
7,111,763 B2 * 9/2006 Masuda ..... B05B 11/0013 222/386.5
8,196,620 B2 * 6/2012 Fransen ..... B65D 83/62 141/10
8,322,571 B2 * 12/2012 Hovinen ..... B01J 4/02 222/65
8,336,734 B2 * 12/2012 Ware ..... B67D 7/0261 137/210
8,453,888 B2 * 6/2013 Sommerfield ..... B67D 1/0406 222/129
8,561,853 B2 * 10/2013 De Mei ..... B65D 81/245 222/153.04
8,622,321 B2 * 1/2014 Vandaele ..... B67D 1/0406 239/310
8,875,425 B2 * 11/2014 Moretti ..... B05B 11/0037 40/310
9,227,827 B1 * 1/2016 Scott ..... B67D 1/0418
9,839,928 B2 * 12/2017 Park ..... B05B 15/30
2003/0205285 A1 * 11/2003 Kelly ..... B65B 3/04 141/2
2004/0035881 A1 * 2/2004 Hammarth ..... B05B 1/3046 222/105
2004/0182888 A1 * 9/2004 Hickert ..... B65D 81/245 222/386.5
2004/0188449 A1 * 9/2004 Thompson ..... F17C 1/00 220/723
2006/0163290 A1 * 7/2006 Ehret ..... B67D 1/0425 222/386.5
2007/0119875 A1 * 5/2007 Ehret ..... B67D 1/045 222/386.5
2009/0008356 A1 * 1/2009 Gadzic ..... B65D 47/265 215/310
2009/0095776 A1 * 4/2009 Turner ..... B67D 1/045 222/386.5
2009/0212071 A1 * 8/2009 Tom ..... B65B 31/003 222/95
2011/0210148 A1 * 9/2011 Nelson ..... B67D 7/025 222/386.5
2012/0091170 A1 * 4/2012 Maget ..... A01M 1/2044 222/386.5
2012/0292338 A1 * 11/2012 Smith ..... B65B 31/025 222/95
2013/0062302 A1 * 3/2013 Otero ..... B65D 23/02 215/12.1
2013/0098946 A1 * 4/2013 Peirsman ..... B67D 1/04 222/399
2013/0277329 A1 * 10/2013 DeFelice ..... B65D 83/0055 215/366
2014/0246396 A1 * 9/2014 Jepson ..... B65D 81/245 215/260
2014/0305079 A1 * 10/2014 Ware ..... B65B 3/18 53/405
2014/0312059 A1 * 10/2014 Dziuk ..... B67D 1/045 222/386.5

* cited by examiner

METHOD FOR FILLING A CONTAINER WITH A LIQUID

CROSS-REFERENCE TO RELATED APPLICATIONS

This application is a continuation application of United States application for patent Ser. No. 14/113,427, having a filing date of 23 Oct. 2013, said United States application for patent being a national stage filing of international application No. PCT/DE2012/000309 having an international filing date of 22 Mar. 2012 and designating the United States, said international application claiming a priority date of 5 May 2011, based on prior filed German patent application No. 10 2011 100 560.2, the entire contents of the aforesaid United States application for patent, the aforesaid international application, and the aforesaid German patent application being incorporated herein by reference.

BACKGROUND OF THE INVENTION

The invention concerns a method for filling a container with a liquid that is in particular designed for consumption.

For filling a container, in particular a bottle, with a liquid that is designed for consumption, in particular a beverage, this liquid is fed into the container, for example, by means of a supply tube. The problem in this connection is that the liquid is exposed to ambient air with the result of undesirable gas release, gas exchange, or gas introduction.

Based on this, it is the object of the invention to develop a method for filling a container with a liquid that is in particular designed for consumption without the liquid coming into contact with the gas contained in the bottle.

SUMMARY OF THE INVENTION

The technical solution is characterized in that into the empty container first at least one balloon-type body is inserted that is liquid-tight relative to the liquid as well as gas-tight, the at least one balloon-type body is filled and inflated with an expansion medium so that the balloon-type body fills out the interior of the container, and the expansion medium escapes again from the balloon-type body so that, into the intermediate space between the balloon-type body and the container generated thereby, the liquid to be filled in is supplied.

In this way, an effective method is provided for filling, without gas contact, a container with a liquid that is designed in particular for consumption. The method is characterized in that the liquid during the filling process does not come into contact with a gas, for example, air or another gas. The advantage of this method resides thus in that the liquid, while the container is being filled, is not subjected to any gas release, gas exchange, or gas introduction. Performing the method provides that into the container first at least one balloon-type body is inserted. In the initial state, the latter can be of any shape. Since this balloon-type body after insertion into the container is filled by means of a medium, the interior of the container is completely filled in this way. For filling the balloon-type body with the expansion medium there are two possibilities. On the one hand, the expansion medium can be fed with overpressure into the balloon-type body so that it is inflated in this way. On the other hand, the intermediate space between the balloon-type body and the inner wall of the container can be subjected to underpressure so that, as a result of the pressure difference that is generated in this way, the balloon-type body will suck in the expansion medium and is thereby inflated. After filling of the balloon-type body with the expansion medium, the expansion medium escapes again from this balloon-type body. For improving the effect, the expansion medium can be sucked away additionally. In the container a space is formed between the balloon-type body and the inner wall of the container into which the liquid is supplied so that the container is filled with this liquid. This is enhanced when the escape of the expansion medium causes an underpressure which sucks in the liquid to be filled in. A further enhancement is provided when the liquid with respect to the expansion medium has an overpressure and is thus supplied to the container with overpressure. Finally, by throttling the escape of the expansion medium, a counter pressure can be maintained that suppresses the release of, for example, $CO_2$, during inflow of the liquid into the container. Since the balloon-type body is liquid-tight as well as gas-tight, the expansion medium which is contained in this balloon-type body cannot come into contact with the liquid. After complete filling of the container, the balloon-type body is then removed again from the container and is ready for the next filling process.

The invention proposes that the balloon-type body is expandable. This means that this balloon-type body upon filling in the medium will expand like an air-filled balloon and, in reverse, will return into its initial shape upon escape or upon pumping away the medium. When the expandable balloon-type body is filled with air, for example, and, subsequently, for filling the container with the liquid, the air supply of the now full balloon-type body is opened again, the air will escape automatically from the balloon-type body in the same way as air escapes from an air-filled balloon. This is so because the balloon-type body contracts as a result of its flexibility and forces out the air contained therein. This effect is enhanced when the liquid has an overpressure relative to the expansion medium (this is so because only the pressure difference of liquid pressure to the expansion medium pressure plus "restoring force" of the balloon-type body is important). The balloon-type body has the advantage that upon introduction into the container it has only a very minimal volume so that the insertion process can be performed without problems.

Alternatively, it is also conceivable that the balloon-type body is not expandable.

A preferred embodiment proposes that the balloon-type body can be inflated in a targeted fashion and, most importantly, can be emptied again and this in such a way that all liquid to be filled into the container can be supplied without problem to the container. Technically, this can be realized in that the balloon-type body is appropriately profiled, i.e., when the expansion medium is emptied from it, the profile first is emptied in the area of the container opening and then, successively, moves to the container bottom. Alternatively, it is also possible that several balloon-type bodies are provided, for example, a first balloon-type body in the bottom area of the container, a second balloon-type body in the center area of the container, as well as finally a third balloon-type body in the area of the container opening. They are inflated as well as, most importantly, emptied sequentially during the filling process with the liquid.

In a further preferred embodiment, it is proposed that the at least one balloon-type body has correlated therewith an elongate support with which the balloon-type body is inserted into the container. This elongate support is to be understood in a general sense. Basically, this support is an elongate narrow structure which can be inserted without problem together with the balloon-type body through the opening of the container into this container. In reverse, the constructive unit of elongate support and balloon-type body can be removed from the container without problem once filling with the liquid is terminated.

A variant embodiment thereof proposes that the support is arranged in a cap. This means that, after introduction of the support into the container, this cap is resting on the container opening and therefore provides a liquid-tight closure with the container opening for the filling process.

Preferably, the above-described cap has an opening through which the liquid can be supplied.

A first variant of the support in the form of a tube is proposed. The basic principle resides in that the balloon-type body or bodies is/are arranged on a tube wherein the balloon-type body envelopes this tube. When then through the tube the balloon-type body is supplied with an the expansion medium, the balloon-type body is inflated about the tube. For this purpose, the tube, in accordance with the number of balloon-type bodies, is provided with appropriate openings for outflow of the expansion medium. The use of a tube has the advantage that it can be introduced together with the balloon-type body in a very simple way into the container.

A second variant of the support in the form of one or several rods on which the balloon-type body is resting is proposed. Basically, it is also possible in this context that the two variants tube/rod are combined. The rod is to be understood in the most general sense. It is an elongate structure. In contrast to the afore described tube, however, this rod is not in the interior of the balloon-type body but the rod and the balloon-type body are positioned adjacent to each other. The advantage of this rod is, on the one hand, that the balloon-type body can be introduced into the container in a simple way because the rod and the balloon-type body together form essentially a constructive unit. On the other hand, the rod has the advantage that, upon gradual inflation of the balloon-type body, it is positioned between the exterior envelope of this balloon-type body and the inner wall of the container. In this way, a small gap between the outer envelope of the balloon-type body and the inner wall of the container is automatically provided through which air can escape toward the container opening. The advantage is thus that even after complete inflation of the balloon-type body no air pockets can form within the container. The air of these air pockets can escape through the afore described gap without a problem from the container opening.

The invention proposes various configurations of the rod. On the one hand, it can be flexible so that it automatically will adjust to the respective contours. However, the rod can also be relatively rigid. In this case, it is shaped such that it is matched to the inner contour of the container.

Moreover, the leading end of the at least one rod is connected to the leading end of the balloon-type body. For this purpose, a plastic string or the like can be provided. The advantage is that in the initial position the balloon-type body, by fixation at the leading end of the rod, has assumed an extended initial position and, therefore, can be inserted without problem through the container opening into the container. A further advantage resides in that a possibly remaining air pocket in the bottom area of the container is forced to escape toward the support.

The invention proposes that the outer surface of the balloon-type body has raised portions, in particular knob-shaped raised portions. Between these raised portions, a gap for escape of air can be formed. In this way, it is possible, as already disclosed in connection with the rod, that automatically a gap between the exterior envelope of the balloon-type body and the inner wall of the container can be generated through which air can escape toward the container opening. The advantage resides thus again in that, even after complete inflation of the balloon-type body, no air bubbles can form in the container. The air of these air pockets can escape without problem via the afore described gap through the container opening. The knob-shaped raised portions can be, for example, designed in a diamond shape.

As a medium for filling the balloon-type body or bodies, a gas, in particular air, or a liquid, in particular water, can be used.

BRIEF DESCRIPTION OF THE DRAWINGS

Embodiments of a filling device according to the invention for filling a container with a liquid designed for consumption will be described in the following with the aid of the drawings.

DESCRIPTION OF PREFERRED EMBODIMENTS

Figure 1C:
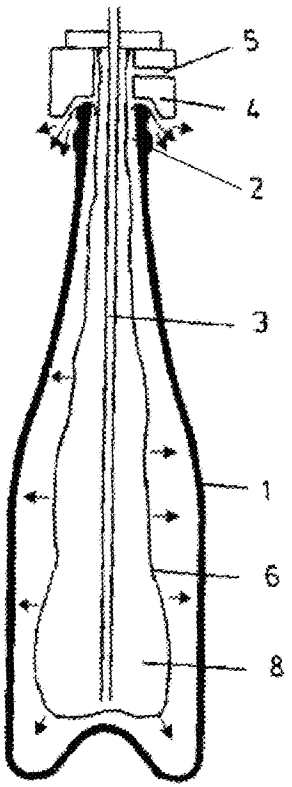
FIGS. 1*a* to 1*f* show a first embodiment wherein various method stages are illustrated.
Figure 1B:
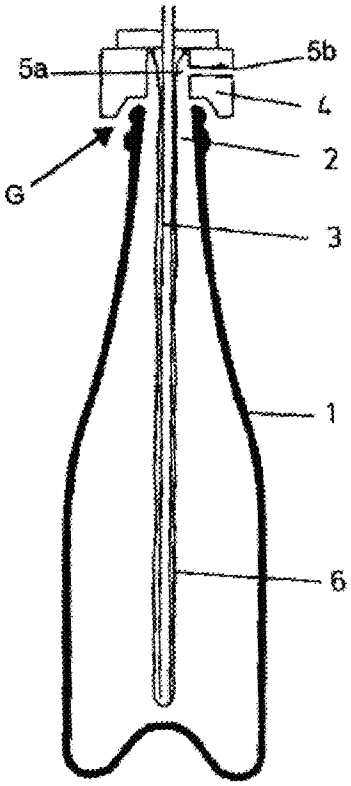
Figure 1A:
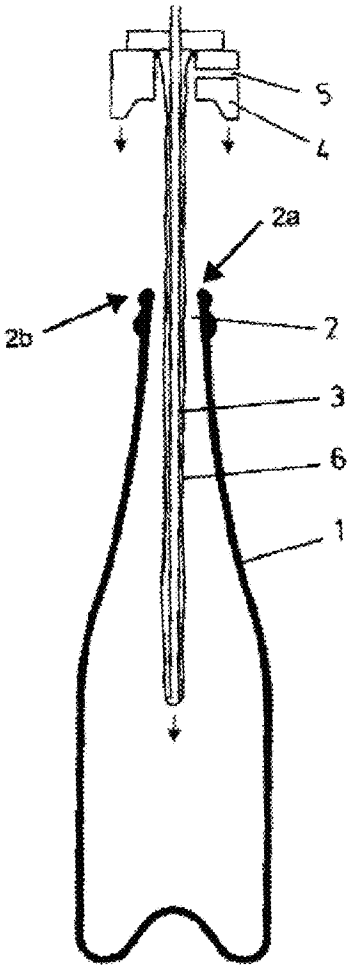

FIG. 1*a* of the first embodiment of the filling device shows a container 1 in the form of a bottle with a container opening 2. The filling device is comprised firstly of a tube 3 that is mounted in a cap 4. This tube 3 is open at the bottom end. Moreover, it has at the top a feed opening for a medium. The cap 4 has finally also a lateral radial opening 5 with radial inward end 5*a* and radial outward end 5*b* (see FIG. 1*b*).

Onto the tube 3, a flexible body 6 is pushed and is attached with its upper circumferential rim seal-tightly on the cap 4. This body 6 can be inflated to a balloon of sorts.

The function is as follows.

The filling device is inserted with the tube 3 leading into the container 1 through the container opening 2. FIG. 1*b* shows the situation with the filling device completely inserted and the cap 4 in this situation located somewhat spaced above the container opening 2, i.e., not seal-tightly attached.

Figure 1F:
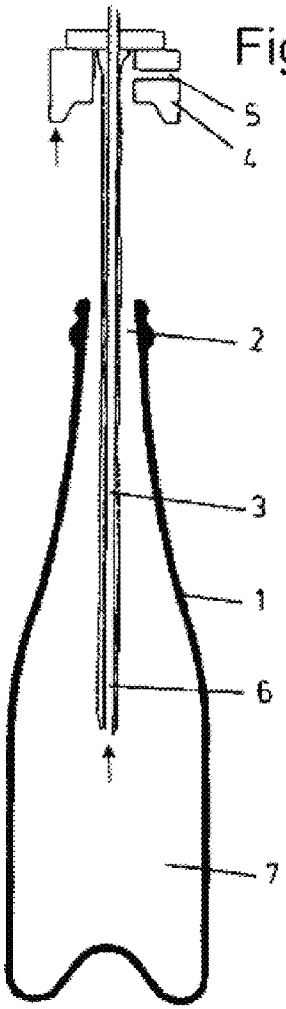

FIG. 1*c* shows how an expansion medium 8, in particular air (but also alternatively a hydraulic expansion medium) is fed to the tube 3. This expansion medium 8 exits from the lower opening of the tube 3 and inflates thereby gradually the body 6 to a balloon-type body 6. The air that is contained in the container 1 escapes in this context through the ring-shaped intermediate gap G between the top face 2*a* of the rim 2*b* of the container opening 2 and the cap 4. The final situation is shown in FIG. 1*d*. It shows how the balloon-shaped body 6 is completely contacting the inner wall of the container 1. Also, the cap 4 now has been seal-tightly placed onto the container 1.

There are two possibilities for filling the balloon-type body 6 with the expansion medium 8.

On the one hand, the expansion medium 8 can be supplied with overpressure to the balloon-type body 6 so that the latter is inflated in this way.

On the other hand, underpressure can be applied to the intermediate space between the balloon-type body 6 and the inner wall of the container 1 so that, as a result of the produced pressure difference, the balloon-type body 6 will suck in the expansion medium 8 and be inflated in this way.

Figure 1E:
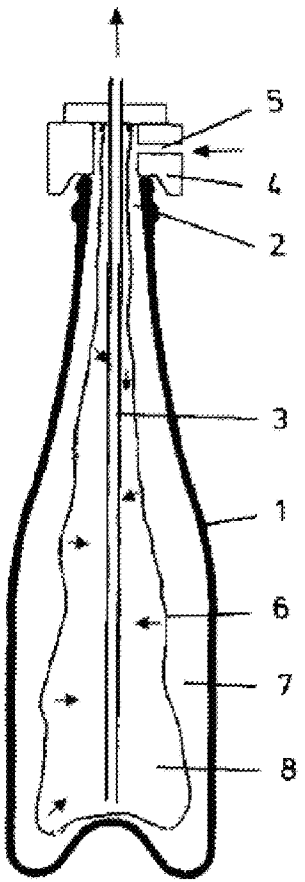
Figure 1D:
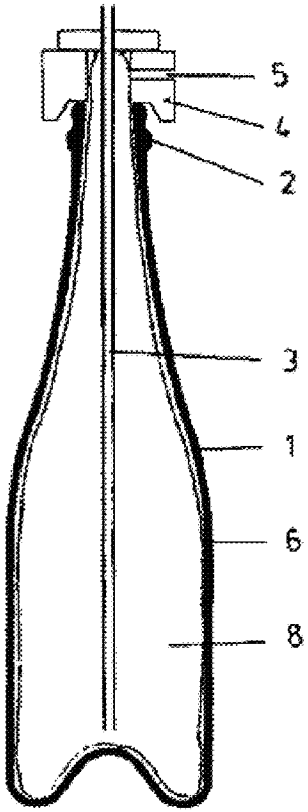
Figure 3A:
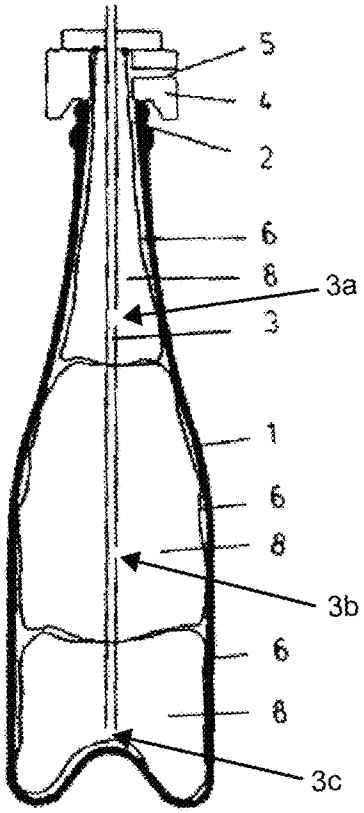
FIGS. 3*a* to 3*d* show a third embodiment of the device using three balloon-type bodies, also in various method stages.

As illustrated in FIG. 1*e*, the expansion medium 8 subsequently will escape again. By throttling the escaping expansion medium 8, a counter pressure is maintained that suppresses the release of, for example, $CO_2$ during inflow of the liquid 7 into the container 1. Because of its elasticity, the balloon-type body 6 contracts. Through the opening 5 in the cap 4, the liquid 7 is supplied to the container 1. The liquid 7 displaces the balloon-type body 6 with the required volume. The intermediate space between the balloon-type body 6 and the inner wall of the container 1 depends on the quantity of the supplied liquid 7.

After complete filling of the container 1, the filling device is pulled out of the container 1 again (FIG. 1*f*).

Figure 2:
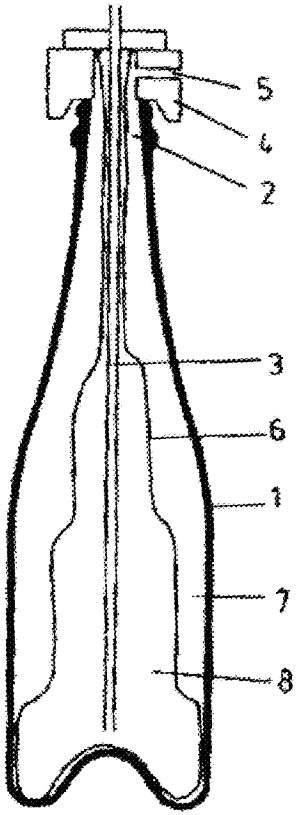
FIG. 2 shows a second embodiment of the device.

FIG. 2 shows a somewhat modified embodiment of the balloon-type body 6. Here it is shown that the balloon-type body 6 upon filling in the expansion medium 8 will inflate in a profiled way such that first the bottom area of the container 1 is filled out, subsequently the central container area, and finally the neck area of the container 1. Emptying of the balloon-type body 6 for the filling process is then realized in reverse order.

FIGS. 3*a* to 3*d* show a further modified embodiment of the filling device. A total of three balloon-type bodies 6 are provided that are secured on top of each and arranged so as to envelope the tube 3. Each of these three balloon-type bodies 6 has associated therewith an exit opening 3*a*, 3*b*, 3*c* of the tube 3.

Figure 3D:
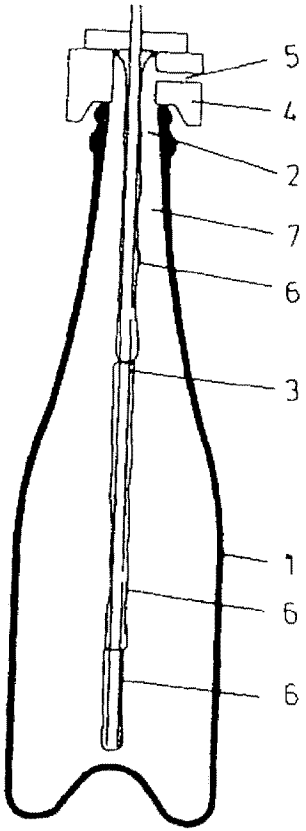
Figure 3C:
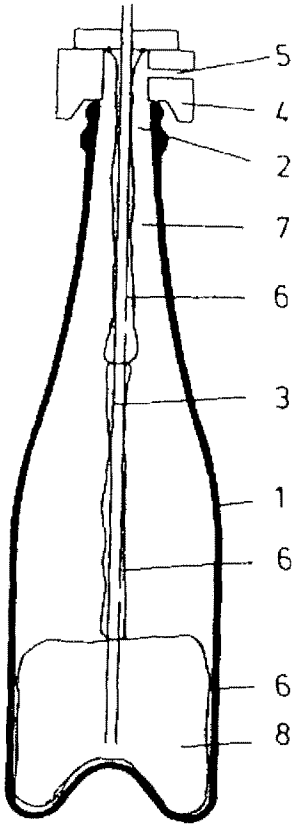
Figure 3B:
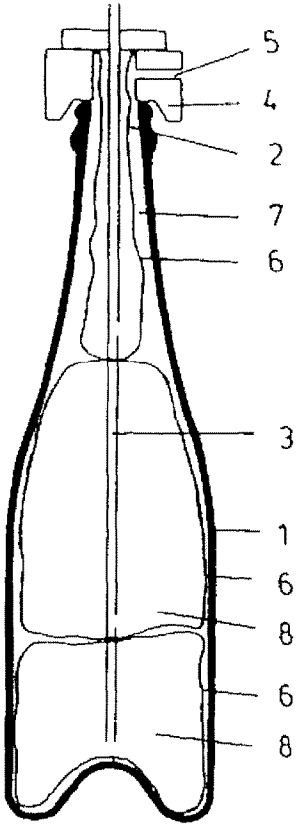

In this embodiment, first the lowermost balloon-shaped body 6 is inflated (FIG. 3*b*), subsequently the central balloon-type body 6 (FIG. 3*c*) as well as finally the uppermost balloon-shaped body 6 (FIG. 3*d*). Emptying of the balloon-type body 6 for the filling process is done in reverse order.

FIGS. 4*a* to 4*d* show a further modified embodiment of the filling device. Here, the basic principle resides in that a rod 9 is arranged on the cap 4 instead of a tube 3. This rod 9 is comprised in particular of plastic material and is formed as an elongate flexible structure. In contrast to the tube 3, the rod 9 does not extend into the balloon-type body 6 but the balloon-type body 6 and the rod 9 are instead positioned side-by-side. The leading end of the balloon-type body 6 is connected with the leading end of the rod 9 by a string 10 or the like.

Moreover, in FIGS. 4*b* to 4*e* it can be seen that the upper end of the balloon-type body 6 in the area of the valve opening of the cap 4 is resting directly on the inner wall of the axial through bore that is formed in this cap 4. This has the advantage that no air gap remains with which the liquid 7 might come into contact. This configuration is also usable in connection with the afore described embodiments.

Figure 4C:
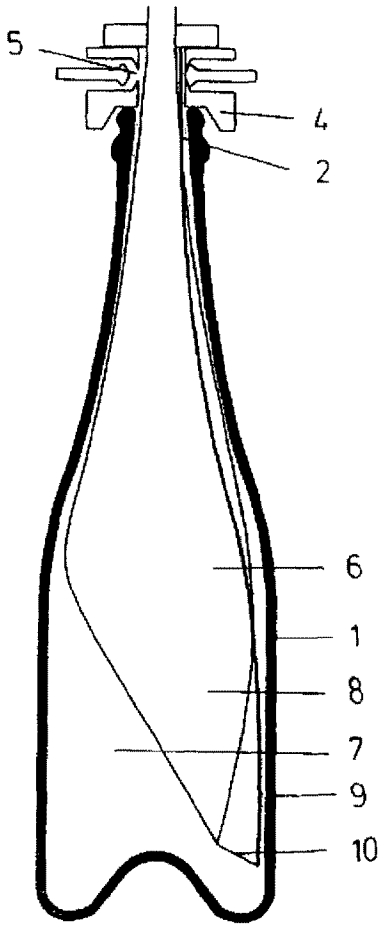
FIGS. 4*a* to 4*f* show a fourth embodiment wherein various method stages are illustrated.
Figure 4B:
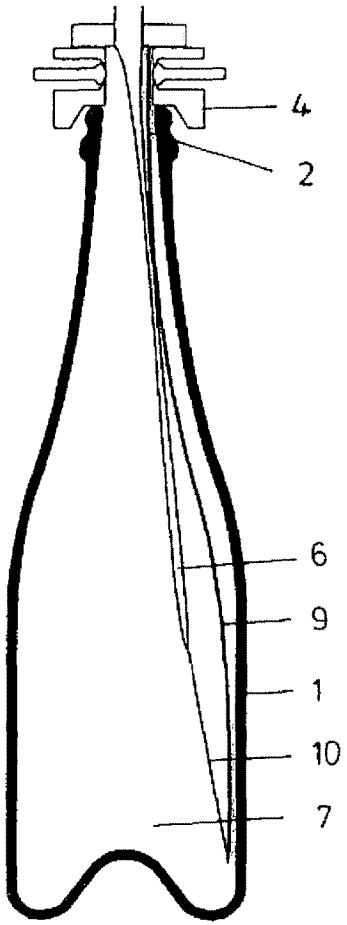
Figure 4A:
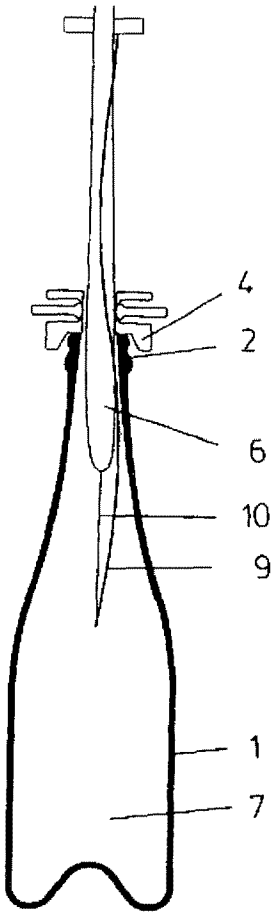
Figure 4F:
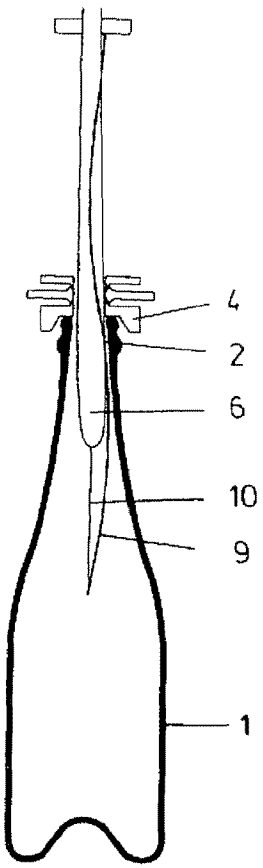
Figure 4E:
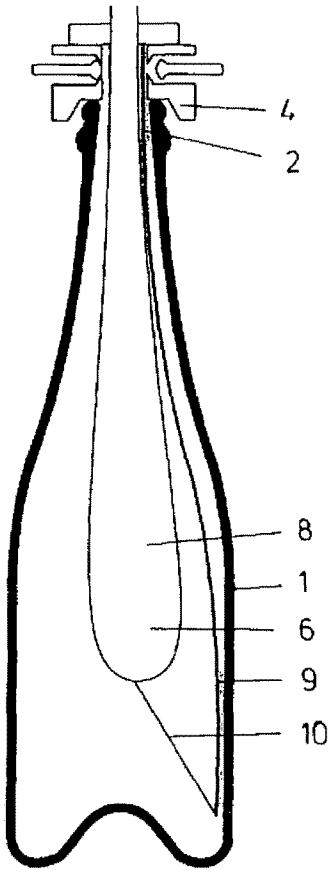
Figure 4D:
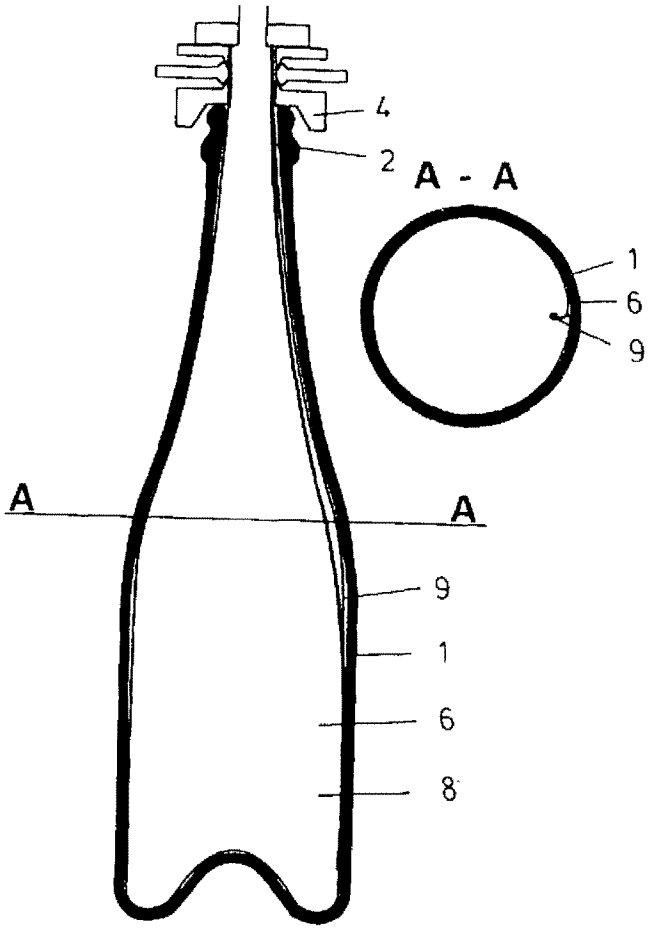

The basic principle of filling corresponds to the basic principle as already disclosed above. This means that the rod 9 with its balloon-type body 6 is inserted into the container opening 2 of the container 1 (FIGS. 4*a* and 4*b*). After opening a valve, the balloon-type body 6 is filled with air so that, as a result of the associated displacement effect, the air that is contained in the container 1 is pressed out and thus escapes through an outlet valve (FIGS. 4*c* and 4*d*). Likewise, it is also possible to apply a vacuum to the container 1 so that the balloon-type body 6 is filled with air as a result of the pressure difference.

Subsequently, the air is then released again from the balloon-type body 6. Since the balloon-type body 6 is similar to an air-filled balloon of sorts, upon release of the air the latter will contract automatically and therefore will force out the air contained in the balloon-type body 6 (FIG. 4*e*). At the same time, the liquid 7 is sucked into the container 1 or the liquid 7 is supplied under pressure. Subsequently, the filling device can be removed again from the container 1 and can be used for a subsequent filling process (FIG. 4*f*).

The advantage in using the afore described rod 9 is that the latter, upon filling the balloon-type body 6 with air, is positioned between the outer wall surface of this balloon-type body 6 and the inner wall surface of the container 1 in such a way that along the rod 9 a gap is formed. In this way, a possibility is provided that all air can escape from the container inasmuch as any air pockets should form in case the balloon-type body 6 inflates in an unfavorable way. This is illustrated in the section illustration of FIG. 4*d*. The gap will be reduced automatically with increasing inflation of the balloon-type body 6. The air gap essentially ensures by itself that it is minimized or eliminated.

LIST OF REFERENCE CHARACTERS

1 container
2 container opening
3 tube
4 cap
5 opening
6 balloon-type body
7 liquid
8 expansion medium
9 rod
10 string

What is claimed is:

1. A method for filling a bottle with a liquid, the method comprising:

providing a cap comprising an axial through bore and a radial opening that extends in a radial direction through the cap, the radial opening having a radial inward end opening into the axial through bore and further having a radial outward end;

providing a balloon body that is liquid-tight relative to the liquid and gas-tight, the balloon body extending through the axial through bore, the balloon body comprising an upper circumferential rim, wherein the balloon body is connected seal-tightly to the cap with the upper circumferential rim above the radial inward end of the radial opening, and the balloon body further having a balloon bottom end extending downwardly away from the cap;

providing an elongate support associated with the balloon body and connected to the cap;

inserting the balloon bottom end and the elongate support into the bottle through a container opening of the bottle;

positioning the cap in a first position at a spacing above a top face of a rim of the container opening so that a ring-shaped intermediate gap is defined between a bottom side of the cap and the top face;

inflating the balloon body with an expansion medium until the balloon body fills out an interior of the bottle to thereby force out air contained in the interior of the bottle through the ring-shaped intermediate gap;

subsequently fluid-tightly fitting the cap in a second position on the top face of the container opening;

creating an intermediate space between an outer surface of the balloon body and an inner wall of the bottle by allowing the expansion medium to escape from the balloon body;

supplying the liquid through the radial opening and through the axial through bore into the intermediate space.

2. The method according to claim 1, further comprising selecting a non-elastic material for the balloon body.

3. The method according to claim 1, wherein the step of supplying the liquid comprises filling the interior of the bottle successively with the liquid from the container opening toward an end of the bottle remote from the container opening.

4. The method according to claim 1, wherein the elongate support is a tube provided with at least one exit opening for the expansion medium, the method further comprising:

arranging the balloon body liquid-tightly and gas-tightly on the tube and enveloping the tube with the balloon body at least partially so that the balloon body is resting on the tube prior to inflating;

in the step of inflating, supplying the expansion medium through the tube so that the expansion medium enters the balloon body through the exit opening of the tube to inflate the balloon body;

wherein, in the step of allowing the expansion medium to escape, the expansion medium escapes from the balloon body though the exit opening of the tube.

5. The method according to claim 1, wherein the elongate support is at least one rod on which the balloon body is resting.

6. The method according to claim 5, wherein the at least one rod is flexible.

7. The method according to claim 5, further comprising providing the at least one rod with a longitudinal contour matched to an inner contour of the bottle.

8. The method according to claim 5, further comprising connecting a leading end of the at least one rod to the balloon bottom end by a string or a wire.

9. The method according to claim 1, further comprising providing an outer surface of the balloon body with raised portions.

10. The method according to claim 9, wherein the raised portions are knob-shaped.

11. The method according to claim 1, wherein the expansion medium is a gas.

12. The method according to claim 1, wherein the expansion medium is air.

13. The method according to claim 1, wherein the expansion medium is a liquid.

14. The method according to claim 1, wherein the expansion medium is water.

* * * * *